US012510338B2

(12) United States Patent
Stjepanovic

(10) Patent No.: US 12,510,338 B2
(45) Date of Patent: Dec. 30, 2025

(54) BULLET FEEDER

(71) Applicant: ARMANOV D.O.O., Trzin (SI)

(72) Inventor: Savo Stjepanovic, Trzin (SI)

(73) Assignee: ARMANOV D.O.O, Trzin (SI)

( * ) Notice: Subject to any disclaimer, the term of this patent is extended or adjusted under 35 U.S.C. 154(b) by 0 days.

(21) Appl. No.: 18/616,142

(22) Filed: Mar. 25, 2024

(65) Prior Publication Data

US 2025/0189282 A1 Jun. 12, 2025

(51) Int. Cl.
*F42B 33/00* (2006.01)

(52) U.S. Cl.
CPC ..... *F42B 33/002* (2013.01)

(58) Field of Classification Search
CPC ..... F42B 33/002
USPC ..... 86/46
See application file for complete search history.

(56) References Cited

U.S. PATENT DOCUMENTS

| | | | | |
|---|---|---|---|---|
| 4,312,438 | A * | 1/1982 | Vatsvog | B65G 47/1457 221/160 |
| 7,552,668 | B1 | 6/2009 | Gonzalez | |
| 8,661,959 | B2 | 3/2014 | Koskela | |
| 10,907,945 | B2 | 2/2021 | Puchosic | |
| 11,639,833 | B2 * | 5/2023 | Slevin | F41A 9/83 42/87 |
| 2008/0053297 | A1 * | 3/2008 | Koskela | F42B 33/10 86/27 |

* cited by examiner

*Primary Examiner* — Bret Hayes
(74) *Attorney, Agent, or Firm* — The Watson IP Group; Jovan N. Jovanovic

(57) ABSTRACT

The object of the invention is a bullet feeder for use in ammunition reloading devices. The bullet feeder of the invention comprises a static support (1), a rotary ring (2) provided with pockets (3) for receiving bullets (4), a container (5) for bullets (4), a sorting bridge (6), a guide (7) for conveying the correctly oriented bullets (4) to a die (40) for inserting bullets (4) into a cartridge case and a drive (8) of the rotary ring (2). The feeder of the invention, with its appropriately shaped pockets (3) and sorting bridge (6), exploits the shape of the bullet (4) to position it correctly in the position of insertion. Due to the specific shape and positioning of the sorting bridge (6), the bullet feeder of the invention can be easily adapted to different calibres and different shapes of bullets.

12 Claims, 6 Drawing Sheets

BULLET FEEDER

BACKGROUND OF THE DISCLOSURE

The object of the invention is a bullet feeder for use in ammunition reloading devices. The feeder of the invention sorts the bullets from a bullet hopper so that the incorrectly oriented bullets fall back into the container by gravity and the correctly oriented bullets move along a guide by gravity to a bullet feeder die. The bullet must always be inserted correctly into a case, so that the rear of the bullet enters the case first. The bullet is usually substantially cylindrical in shape and has a substantially conically shaped head (apex), the head diameter gradually tapering towards the apex, and a rear portion shaped substantially as a flat surface. The feeder of the invention, with its appropriately shaped pockets and sorting bridge, exploits the shape of the bullet to position it correctly in the position of insertion. Due to the specific shape and positioning of the sorting bridge, the bullet feeder of the invention can be easily adapted to different calibres and shapes of bullets having a substantially conical apex, such as round nose, flat nose, sharp tip, hollow point, insertion tip, soft point, semi wadcutter.

Ammunition reloading started years ago in an effort by shooters to make their own ammunition instead of being satisfied with the ammunition on sale. So, many professional and amateur sport shooting competitors load ammunition at home, mainly because of more accurate and consistent loading, and because it is cheaper. Spent cases are collected and reloaded. Ammunition reloading is useful for many types of ammunition, especially for ammunition consisting of a cartridge case, primer, powder and bullet. As a lot of ammunition can be used for training, it pays to load ammunition at home. In addition, home-loaded ammunition can be of higher quality than store-bought ammunition, which is reflected in better results in training and competitions.

Until the mid-1970s, most companies in the ammunition reloading industry produced only hand-operated reloading products, which allowed only one cartridge case to be reloaded at a time, which was very time-consuming. With a rapid development of competition shooting, progressive ammunition reloading devices came on the market that perform separate manual reloading operations at the same time, allowing large quantities of ammunition to be reloaded quickly and accurately. One of the separate operations is the insertion of a bullet into a cartridge case, where the bullet must be correctly oriented. For this reason, various bullet feeders have been developed to automatically feed correctly oriented bullets into their seating position.

U.S. Pat. No. 7,552,668 describes a bullet feeder having a rotary ring with pockets for receiving bullets from a container, wherein the pockets are formed in a way that their diameter is tapered in a radial direction towards the interior of the ring to allow only the correctly oriented bullets to enter the pocket with their full length, while the incorrectly oriented bullets protrude out of the pocket with their apex and are removed from the pocket when they strike a boss during the movement of the rotary ring, which pushes the incorrectly oriented bullet out of the pocket. A disadvantage of this feeder is that it cannot be used for several different cartridge calibres without major modifications.

U.S. Pat. Nos. 8,661,959 and 10,907,945 describe a bullet-orienting system comprising a conveyor ring with grooves for receiving bullets, which conveys the bullets from a container to a feed tube, and comprising a bullet-orienting structure positioned along a bullet conveyance path, which flips the bullets which are misoriented in the grooves 180 degrees so that when they reach the opening by rotation of the transport ring, they are correctly oriented and can enter the outlet tube through the opening. A disadvantage of this system is its many components. In addition, said system does not allow the use for a wide range of calibres without changing the conveyor ring.

Said disadvantages are solved by the bullet feeder of the invention which can be used for comparable calibres (e.g. 9 mm and 10 mm) and bullet shapes with an essentially conical apex, without adjustments to the rotary ring, the feeder being compact and inexpensive and can be used on commercially available ammunition reloading devices.

BRIEF DESCRIPTION OF THE DRAWINGS

The invention will be described in more detail hereinbelow and illustrated on the figures which show.

DETAILED DESCRIPTION OF THE DISCLOSURE

Figure 1:
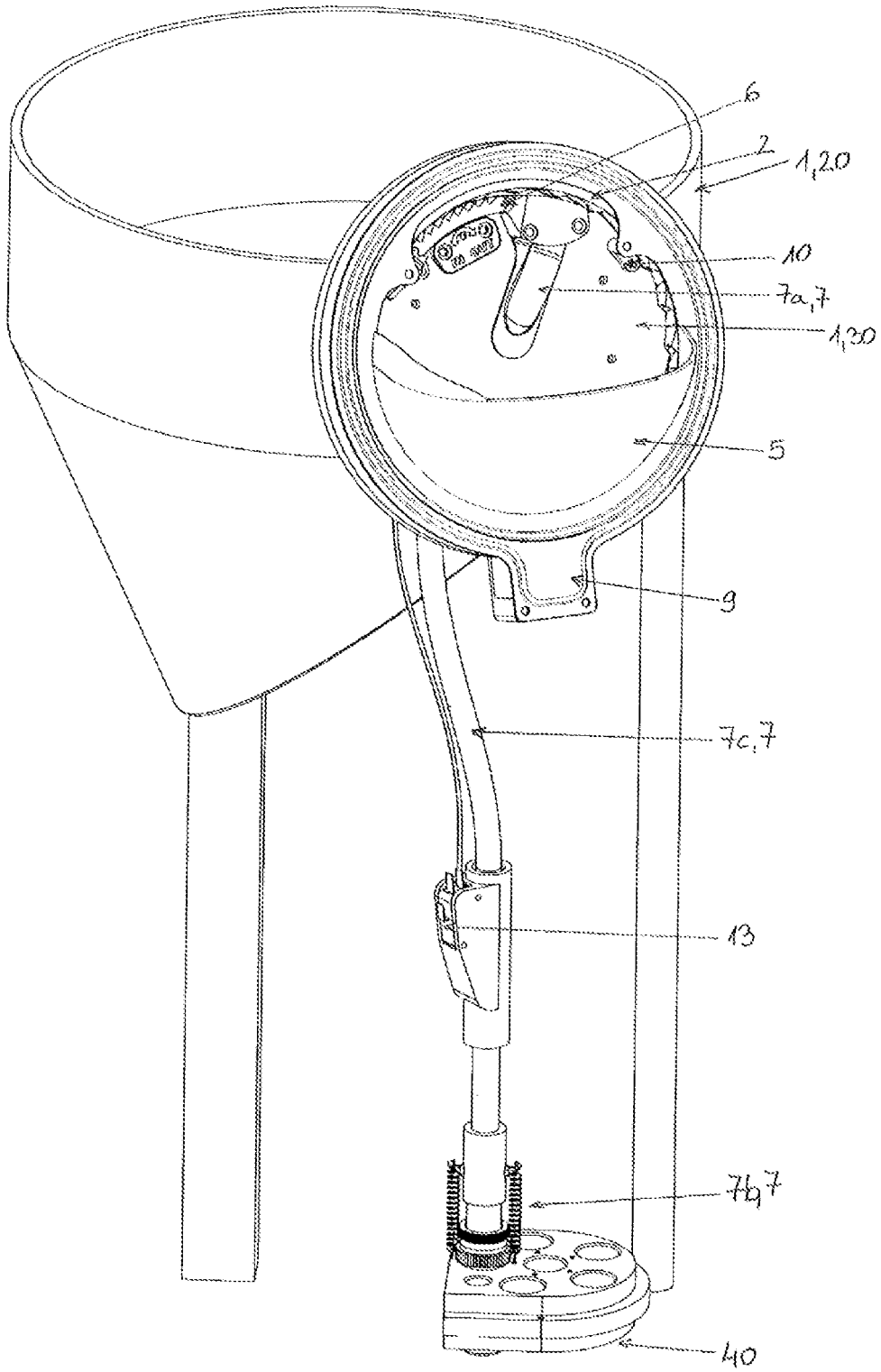
FIG. 1 shows an embodiment of a bullet feeder of the invention in axonometric projection—front view
Figure 2:
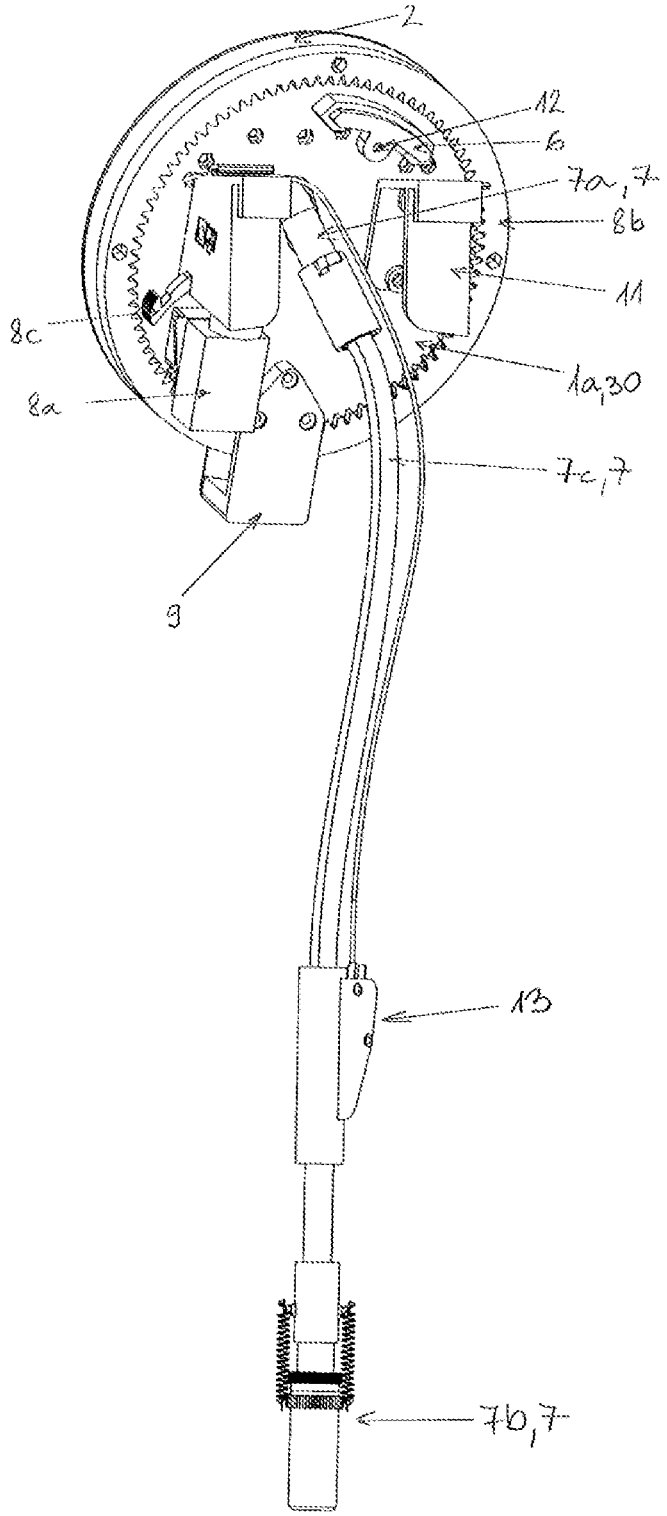
FIG. 2 shows an embodiment of a bullet feeder of the invention in axonometric projection—rear view—without a stand
Figure 3:
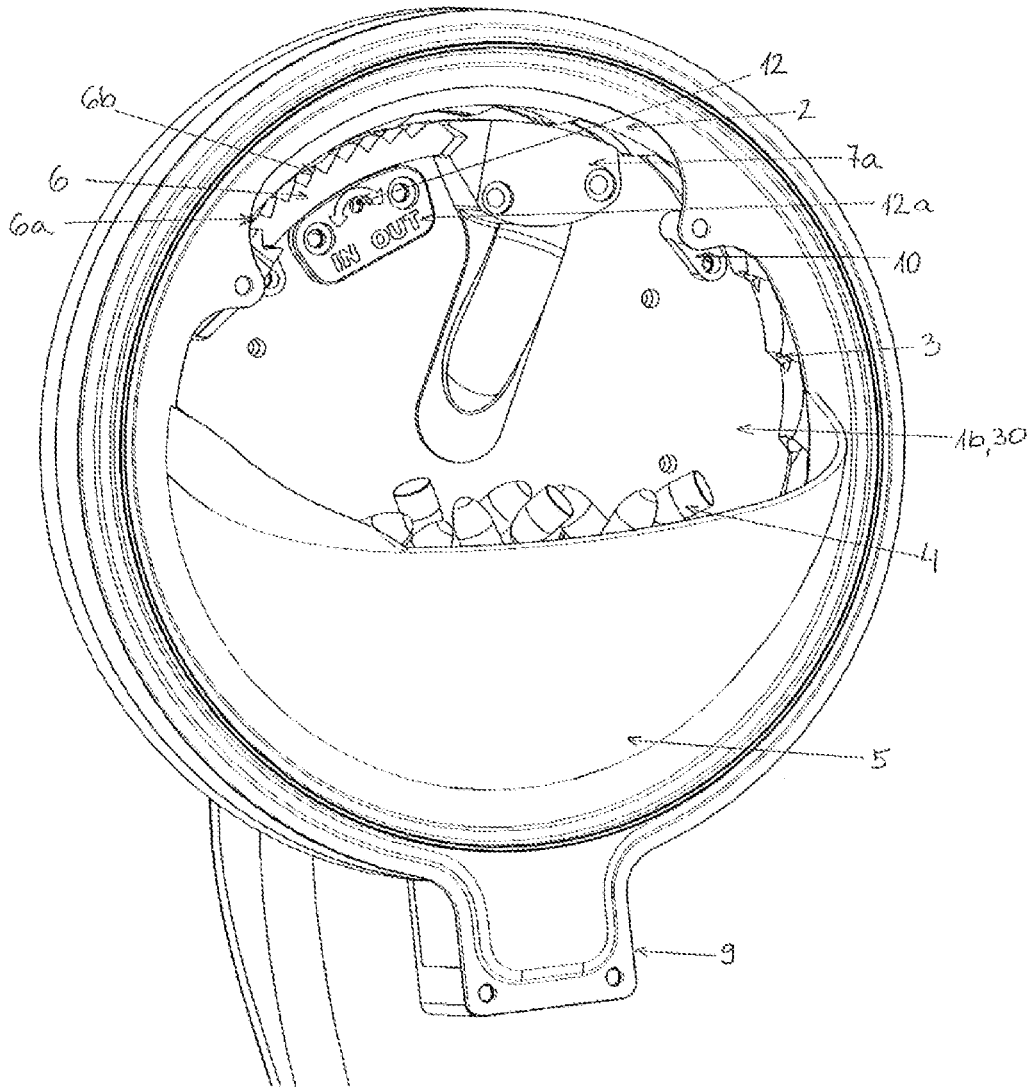
FIG. 3 shows an embodiment of a bullet feeder of the invention with bullets in a container
Figure 4:
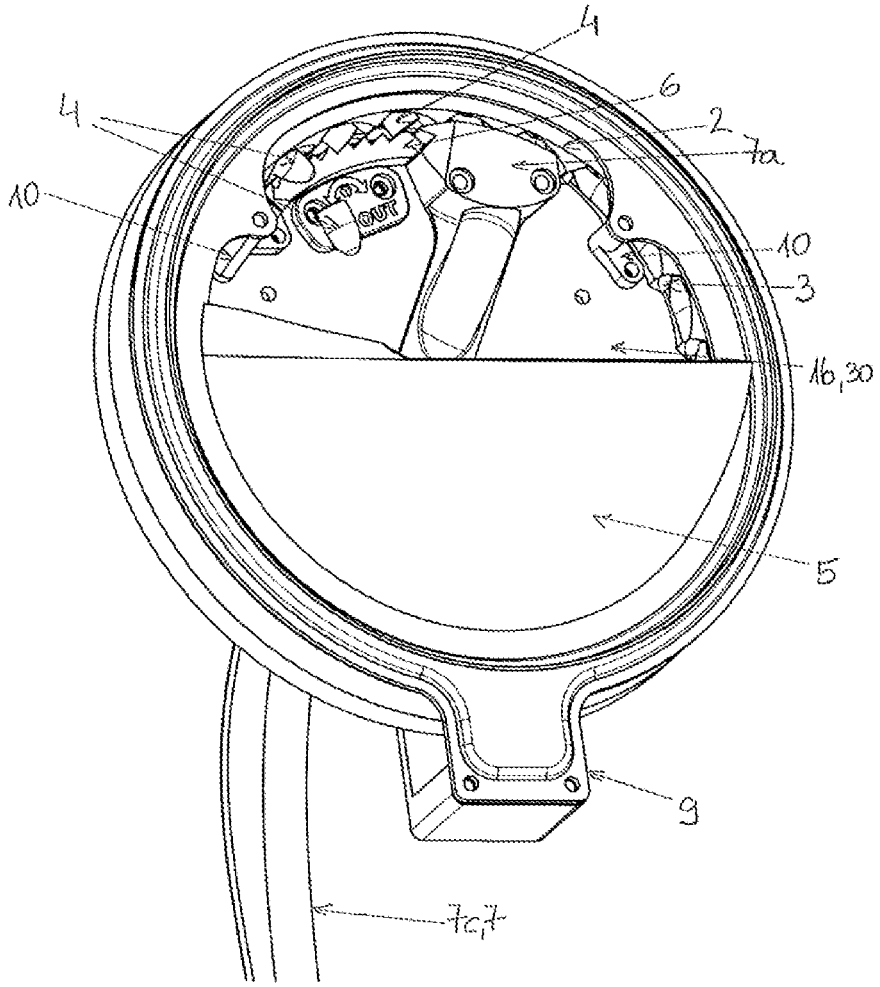
FIG. 4 shows an embodiment of a bullet feeder of the invention with bullets in the area of a sorting bridge
Figure 5:
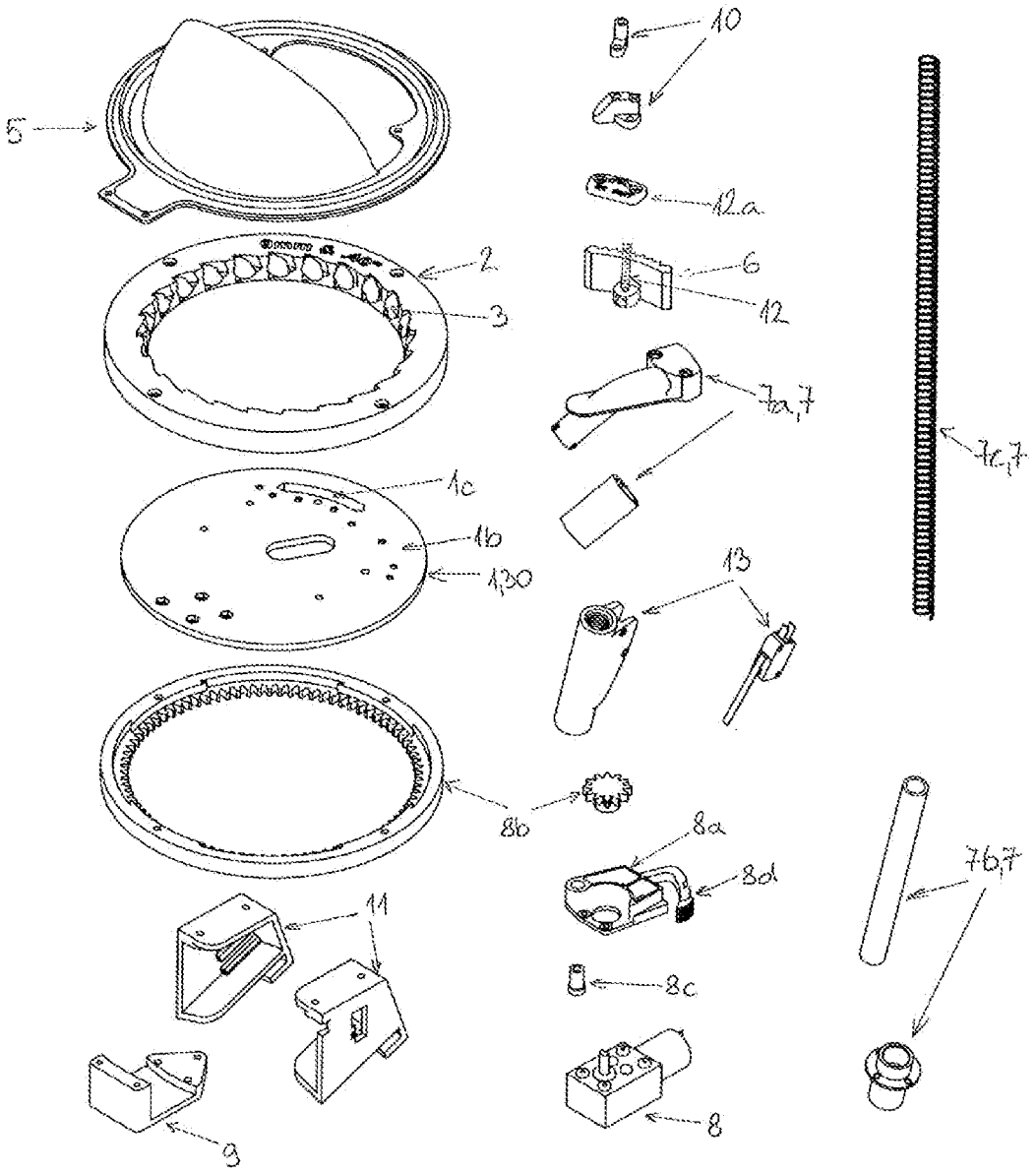
FIG. 5 shows an embodiment of a bullet feeder of the invention in exploded view
Figure 6:
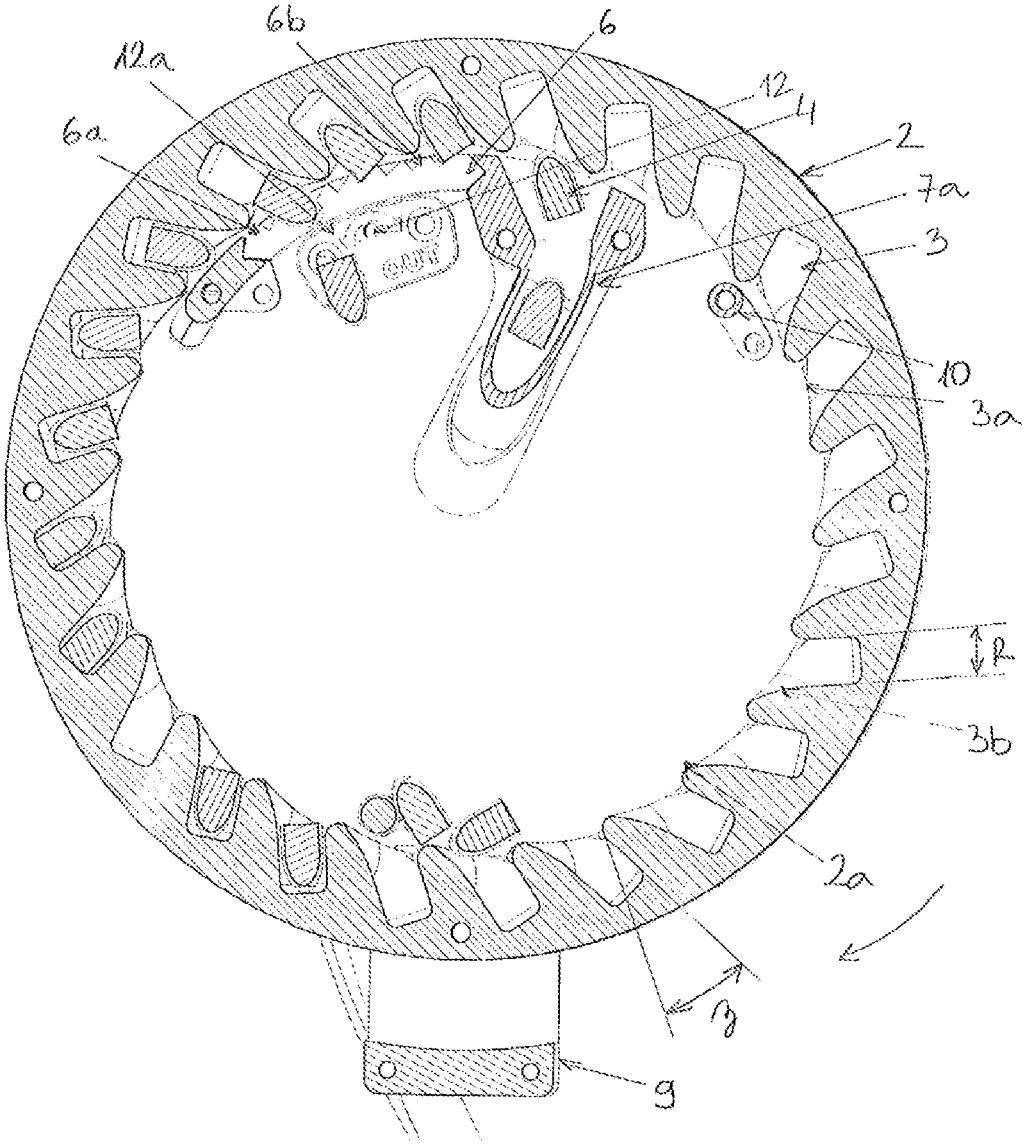
FIG. 6 shows an embodiment of a rotary ring during operation—cross-section

The bullet feeder of the invention comprises a static support 1, a rotary ring 2 provided with pockets 3 for receiving bullets 4, a container 5 for bullets 4, a sorting bridge 6, a guide 7 for conveying the correctly oriented bullets 4 to a die 40 for inserting bullets 4 into a cartridge case (not shown in figure) and a drive 8 of the rotary ring 2.

The static support 1 is designed to hold the individual components of the bullet feeder in such a way as to allow them to interact with each other, as will be described below.

The rotary ring 2 is pivotally fixable with respect to the static support 1. In one embodiment, the pivotal fixation is implemented by inserting the rotary ring 2 into the space between the container 5 and the static support 1, wherein the container 5 is fixed to the static support 1 and the required distance of the container 5 from the static support 1 for forming the intermediate space, into which the rotary ring 2 is inserted and is allowed to rotate, is formed by means of a support bracket 9 and at least one spacer 10, preferably two spacers 10. The support bracket 9 and the spacers 10 provide a fixed connection between the container 5 and the static support 1, while at the same time providing an empty intermediate space into which the rotary ring 2 is inserted.

The rotary ring 2 may be positioned vertically, so that its axis of rotation is horizontal, or the rotary ring 2 may be tilted backwards from the vertical by a certain angle, i.e. away from the container 5, so that its axis of rotation is tilted backwards from the horizontal by a certain angle. In one embodiment, the tilting of the rotary ring 2 is implemented by at least one support member 11 fixed to a rear surface 1*a* of the static support 1, to a surface facing away from the container 5. In a preferred embodiment, the tilting of the rotary ring 2 is implemented via two support members 11.

The pockets 3 for receiving bullets 4 are formed around an inner circumference 2*a* of the rotary ring 2 in such a way that an inlet opening 3*a* of a respective pocket 3, through which a bullet 4 can enter the pocket 3, faces the axis of rotation of the rotary ring 2. The pockets 3 extend into the interior of the rotary ring 2 substantially in the radial direction with respect to the rotary ring 2 or at a certain angle β with respect to the radial direction. The configuration of the pockets 3 being at an angle with respect to the radial direction ensures that a bullet 4 subsequently falls out of the pocket 3, thus preventing the bullet 4 from falling out of the pocket 3 before the pocket 3 enters the area of the sorting bridge 6, while at the same time allowing the sorting bridge 6 to be mounted in a higher position, i.e. higher up around the inner circumference 2*a* of the rotary ring 2 in its upper part, and the bullet feeder may be of smaller dimensions. The diameter R of a respective pocket 3 is essentially the same throughout its depth and is greater than the diameter of a bullet 4, so that a bullet 4 can easily enter the pocket 3 either with its apex or its rear portion, but smaller than the length of a bullet 4, so that a bullet 4 can only be positioned in the pocket 3 longitudinally and not transversely. The depth of the pocket 3 is at least such that a bullet 4 can enter substantially completely into the pocket 3 along its length. Preferably, the pockets 3 are equidistantly arranged around the inner circumference 2*a* of the rotary ring 2.

Preferably, the diameter R of a respective pocket 3 is dimensioned in such a way that the bullet feeder can be used for comparable calibre bullets, for example 9 mm and 10 mm calibre bullets, without changing the rotary ring 2, while at the same time providing sufficient tolerance to allow a bullet 4 to move when in the pocket 3.

In one embodiment, the inlet into the opening 3*a* of a respective pocket 3 in the portion facing the direction of rotation of the rotary ring 2 is formed by a chamfer 3*b*. The chamfer 3*b* allows for better mixing of the bullets 4 in the container 5 when the rotary ring 2 is rotating and facilitates the entry of the bullets 4 into the pockets 3. Otherwise, it may happen that the bullets 4 are stuck in some static position and none of them fall into the pocket 3, even though the rotary ring 2 is rotating.

The container 5 is fixed to a front face 1*b* of the static support 1 in such a way that it is located under the entire rotary ring 2, so that a bullet 4 falling out of the pocket 3 can fall back into the container 5. A front wall 5*a* of the container 5 covers at least the lower portion of the rotary ring 2, which is inserted between the container 5 and the static support 1, on its front side. The rotary ring 2 passes through the lowest portion of the container 5 in such a way that the openings 3*a* of the pockets 3 face the interior of the container 5, so that the bullets 4 contained in the container 5 can fall into the pockets 3 due to gravity and possible interaction with each other.

Preferably, the height of the container 5 from the bottom to the top edge is chosen to accommodate a desired number of bullets 4 and to prevent the bullets 4 from falling out of the container 5 due to the interaction with each other and the rotation of the rotary ring 2.

The front wall 5*a* of the container 5 is optionally transparent to show how many bullets 4 are contained in the container 5.

The sorting bridge 6 is movably mounted on the static support 1 around the inner circumference 2*a* of the rotary ring 2 in its upper portion, extending from the portion where the bullets 4 would fall out of the pockets 3 due to gravity and terminating at an inlet 7*a* into the guide 7.

The movable placement of the sorting bridge 6 on the static support 1 is implemented by a slot 1*c* provided in the static support 1, through which the sorting bridge 6 is inserted, and an adjusting screw 12 adapted to move the sorting bridge 6 in the slot 1*c* in a direction parallel to the axis of rotation of the rotary ring 2. The dimensions of the slot 1*c* are adapted to the dimensions of the sorting bridge 6 so that rotation of the adjusting screw 12 in one direction or the other (i.e. clockwise or anticlockwise) enables the sorting bridge 6 in the slot 1*c* to be moved forwards or backwards, respectively (i.e. in a direction parallel to the axis of rotation of the rotary ring 2). In this way it is possible to regulate by how much the sorting bridge 6 extends with its upper surface 6*a*, i.e. the surface facing the inlet openings 3*a*, over part of the inlet openings 3*a* of the pockets 3, or by how much the sorting bridge 6 extends above the inner face 1*b* of the static support 1, i.e. to adjust the width of the overlap by which the sorting bridge 6 partially overlaps the inlet openings 3*a*. The movable placement thus allows the sorting bridge 6, by partially covering the inlet openings 3*a* of the pockets 3, to prevent a bullet 4 from falling out of the pocket 3 due to gravity when the pocket 3 in the upper portion of the rotary ring 2 passes over the sorting bridge 6, when a bullet 4 in the pocket 3 is correctly oriented, i.e. with its rear portion towards the inlet opening 3*a*, and allows a bullet 4 to fall out of the pocket 3 when the bullet 4 in the pocket 3 is oriented in the opposite direction, i.e. with its apex, which is substantially conical in shape, towards the inlet opening 3*a*.

In one embodiment, the adjusting screw 12 may be provided with a cover 12*a* with a visual mark indicating the direction of movement of the sorting bridge 6 in the slot 1*c* forward and backward, or outward and inward relative to the front face 1*b*.

In one embodiment, the upper surface 6*a* of the sorting bridge 6 is stepped to allow a correctly oriented bullet 4 to abut on a step 6*b* with its rear portion, i.e. with its rear surface which is essentially a flat surface, to further prevent the correctly oriented bullet 4 from falling from the sorting bridge 6 or from the pocket 3 as it travels over the sorting bridge 6.

As already mentioned, the bullet feeder of the invention, with its appropriately shaped pockets 3 and sorting bridge 6, exploits the shape of the bullet 4 to position it correctly in the position of insertion. Namely, the bullet 4 with its rear surface, which is essentially a flat surface, abuts on the upper surface 6*a* of the sorting bridge 6, thereby enabling the correctly oriented bullet 4 not to fall out of the pocket 3 and thus off the sorting bridge 6 when the pocket 3 passes over the sorting bridge 6 in the upper portion of the rotary ring 2. On the other hand, an incorrectly oriented bullet 4 with its apex, which is essentially conical in shape, does not abut on the upper surface 6*a* of the sorting bridge 6 and therefore falls out of the pocket 3 and thus off the sorting bridge 6 when the pocket 3 passes over the sorting bridge 6 in the upper portion of the rotary ring 2.

This allows the bullet feeder to be adapted to different comparable calibres and shapes of bullets 4, which have their apex substantially conical in shape. Thus, for larger calibres, the width of the overlap by which the sorting bridge 6 partially covers the inlet openings 3*a* is slightly greater than for smaller calibres.

The guide 7 for conveying the correctly oriented bullets 4 to the die 40 for inserting bullets 4 into a cartridge case comprises an inlet 7*a* of the guide 7 and an outlet 7*b* of the guide 7, wherein the inlet 7*a* of the guide 7 is positioned below substantially the highest point of rotation of the inner circumference 2*a* of the rotary ring 2 and is fixed to the front face 1*b* of the static support 1, so that a correctly oriented bullet 4 from the pocket 3 falls by gravity into the inlet 7*a* of the guide 7 and travels along the guide 7 to the outlet 7*b* of the guide 7. The outlet 7*b* of the guide 7 is fixable to the die 40 for inserting the bullets 4 into the cartridge case. The diameter of the guide 7, including the inlet 7*a* and the outlet 7*b*, is such as to allow the bullet 4 to be moved along it by gravity. The diameter of the guide 7 is thus greater than the diameter of the bullet 4 but smaller than the length of the bullet 4 to prevent the bullet 4 from turning and possibly jamming as it travels from the inlet 7*a* to the outlet 7*b* of the guide 7.

A drive 8 of the rotary ring 2 is fixed with respect to the static support 1 and is coupled to the rotary ring 2 in terms of drive to ensure that the rotary ring 2 rotates in a defined direction at a defined speed. The drive 8 is configured as an electric motor with a suitable power supply, for example a battery or other suitable voltage source.

In one embodiment, the attachment of the drive 8 is by means of a holder 8*a* of the drive 8, which is attached to the rear face 1*a* of the static support 1.

In one embodiment, a drive connection is made via gears 8*b* and an axle 8*c* of the drive 8, wherein one gear is mounted on the axle 8*c* of the drive 8 and the other gear is mounted on the rotary ring 2.

Optionally, the holder 8*a* of the drive 8 is provided with a pin 8*d* which allows the contact between the two gears 8*b* to be manually disengaged, thereby allowing manipulation in the bullet feeder if necessary.

The guide 7 optionally comprises a sensor connected to a switch 13 for switching the drive 8 of the rotary ring 2 on/off. When the sensor detects that the height of the bullets 4 in the guide 7 has reached a predetermined height, the sensor transmits a corresponding signal to the drive 8 which switches off. When the sensor detects that the height of the bullets 4 in the guide 7 has fallen under a predetermined height, the sensor transmits a corresponding signal to the drive 8 which switches on again. In this way, the blockage of the guide 7 is prevented.

In one embodiment, the static support 1 consists of a stand 20 and a central plate 30 which is detachably fixable to the stand 20 by means of support members 11, and the individual components of the bullet feeder are attached to the central plate 30 in such a way that their mutual interaction is made possible as previously described.

Embodiment

In the embodiment, the bullet feeder comprises a static support 1 consisting of a stand 20 and a central plate 30 which is detachably fixable to the stand 20, in the instant embodiment the case feeder, by means of two support members 11. The individual components of the bullet feeder are fixed to the central plate 30. The rotary ring 2 is inserted between the container 5 and the central plate 30, the container 5 being fixed to the central plate 30. The required distance of the container 5 from the central plate 30 to form the intermediate space into which the rotary ring 2 is inserted is implemented by means of a support bracket 9 and two spacers 10. The rotary ring 2 is inclined by an angle of 20 degrees from the vertical backwards, the inclination of the rotary ring 2 being implemented via two support members 11 fixed to the rear face 1*a* of the central plate 30. The pockets 3 for receiving bullets 4 are provided around the inner circumference 2*a* of the rotary ring 2 and extend into the interior of the rotary ring 2 at an angle β of 30 degrees with respect to the radial direction. Entry into the opening 3*a* of a respective pocket 3 in the portion facing the direction of rotation of the rotary ring 2 is formed by a chamfer 3*b*. The container 5 is fixed to a front face 1*b* of the central plate 30 in such a way that it is located under the entire rotary ring 2. The movable placement of the sorting bridge 6 on the central plate 30 is implemented by a slot 1*c* provided in the central plate 30 and an adjusting screw 12. The rotation of the adjusting screw 12 in one direction or the other (clockwise or anticlockwise) enables setting the width of overlapping, with which the sorting bridge 6 partially covers the inlet opening 3*a*. The upper surface 6*a* of the sorting bridge 6 is stepped. By defining the diameter R of the pockets 3 to be at least 0.5 mm larger than the larger calibre and by setting the overlap width by which the sorting bridge 6 partially overlaps the inlet openings 3*a*, which in this embodiment is approximately equal to one third of the calibre size, the bullet feeder in this embodiment is adapted to calibres of 9 mm and 0.40 inch for the round nose shape of the apex of the bullet 4. The guide 7 for conveying the correctly oriented bullets 4 to the die 40 for inserting bullets 4 into a cartridge case is formed of a flexible tube 7*c*, while the inlet 7*a* of the guide 7 and the outlet 7*b* of the guide 7 are formed as stiff elements. The inlet 7*a* of the guide 7 is fixed to the front face 1*b* of the central plate 30 below substantially the highest point of rotation of the inner circumference 2*a* of the rotary ring 2, so that a correctly oriented bullet 4 from the pocket 3 falls by gravity into the inlet 7*a* of the guide 7 and travels along the flexible tube 7*c* to the outlet 7*b* of the guide 7. The outlet 7*b* of the guide 7 is fixable to the die 40 for inserting the bullets 4 into the cartridge case. The drive 8 of the rotary ring 2 is fixed with respect to the central plate 30 and configured as an electric motor. The attachment of the electric motor 8 is by means of a holder 8*a* which is attached to the rear face 1*b* of the central plate 30. A drive connection is made via gears 8*b* and an axle 8*c* of the electric motor 8, wherein one gear is mounted on the axle 8*c* of the electric motor 8 and the other gear is mounted on the rotary ring 2. The holder 8*a* of the electric motor 8 is provided with a pin 8*c* which allows the contact between the two gears 8*b* to be manually disengaged, thereby allowing manipulation in the bullet feeder if necessary. The guide 7 comprises a sensor connected to a switch 13 for switching the electric motor 8 of the rotary ring 2 on/off. When the sensor detects that the height of the bullets 4 in the guide 7 has reached a predetermined height, the sensor transmits a corresponding signal to the electric motor 8 which switches off. When the sensor detects that the height of the bullets 4 in the guide 7 has fallen under a predetermined height, the sensor transmits a corresponding signal to the electric motor 8 which switches on again. In this way, the blockage of the guide 7 is prevented.

The invention claimed is:

1. A bullet feeder for use in ammunition reloading devices, the bullet feeder configured to sort bullets which are substantially cylindrical in shape and have a substantially conically shaped head and a rear portion shaped substantially as a flat surface, such that incorrectly oriented bullets fall back into a container by gravity, while correctly oriented bullets are conveyed by gravitation to a die for inserting the correctly oriented bullets into cartridge cases, wherein the bullet feeder comprises:

a static support structurally configured to hold individual components of the bullet feeder, a rotary ring having a plurality of pockets for receiving bullets, the rotary ring being pivotally fixable with respect to the static support, a container for bullets which is fixed to a front face of the static support and positioned under the rotary ring, wherein a front wall of the container covers at least a bottom portion of the rotary ring, a sorting bridge movably positioned on the static support around an upper portion of an inner circumference of the rotary ring, wherein the sorting bridge is configured to separate the incorrectly oriented bullets from the correctly oriented bullets when the plurality of pockets in the upper portion of the rotary ring pass over the sorting bridge, a guide for conveying the correctly oriented bullets to the die for inserting the correctly oriented bullets into a cartridge case, and a drive of the rotary ring, wherein the drive is fixed with respect to the static support and is coupled to the rotary ring to allow rotation of the rotary ring in a defined direction at a defined speed;

wherein the plurality of pockets for receiving bullets are formed around the inner circumference of the rotary ring wherein each of the plurality of pockets has an inlet opening which faces an axis of rotation of the rotary ring, and each of the plurality of pockets extend into an interior of the rotary ring, wherein a diameter of each pocket is essentially the same throughout its depth and is greater than a diameter of a bullet but smaller than a length of a bullet;

and wherein the static support comprises a slot, through which the sorting bridge is inserted, and an adjusting screw adapted to move the sorting bridge in the slot, with dimensions of the slot being adapted to dimensions of the sorting bridge to allow rotation of the adjusting screw in clockwise or counterclockwise direction, enabling the sorting bridge in the slot to be moved forwards or backwards, respectively, in a direction parallel to the axis of rotation of the rotary ring, and to regulate by how much the sorting bridge extends with its upper surface over part of the inlet openings of the pockets.

2. The bullet feeder according to claim 1, wherein the rotary ring is inserted into a space between the container and the static support, wherein the space is sized to allow for rotation of the rotary ring after insertion into the space, and wherein the space is fixed by a support bracket and at least one spacer.

3. The bullet feeder according to claim 1, wherein the rotary ring is positioned either vertically, such that its axis of rotation is horizontal, or the rotary ring is tilted backwards from the vertical, such that the axis of rotation is tilted backwards from the horizontal, wherein the tilting of the rotary ring is implemented by at least one support member fixed to a rear surface of the static support.

4. The bullet feeder according to claim 1, wherein the pockets extend into the interior of the rotary ring in either a radial direction with respect to the rotary ring or at an angle with respect to the radial direction, and the pockets are equidistantly arranged around the inner circumference of the rotary ring.

5. The bullet feeder according to claim 1, wherein the inlet into the inlet opening of a respective pocket in the portion facing the direction of rotation of the rotary ring is formed by a chamfer.

6. The bullet feeder according to claim 1, wherein the upper surface of the sorting bridge is stepped to allow the rear portion of a correctly oriented bullet to abut a front surface of a step to prevent the correctly oriented bullet from falling from the sorting bridge and thus from the pocket as it travels over the sorting bridge.

7. The bullet feeder according to claim 1, wherein the adjusting screw is provided with a cover with a visual mark indicating the forward or backward direction of movement of the sorting bridge in the slot forward/backward.

8. The bullet feeder according to claim 1, wherein the guide is formed of an inlet, a flexible tube and an outlet, the inlet being arranged below the highest point of rotation of the inner circumference of the rotary ring and is fixed to the front face of the static support, such that a correctly oriented bullet from the pocket falls by gravity into the inlet and travels along the flexible tube to the outlet, wherein a diameter of the guide is greater than a diameter of the bullet, but smaller than a length of the bullet.

9. The bullet feeder according to claim 1, wherein the drive is an electric motor, with the drive mounted by a holder of the drive, and a drive connection is made via gears and an axle of the drive, and wherein one gear is mounted on the axle of the drive and the other gear is mounted on the rotary ring.

10. The bullet feeder according to claim 9, wherein the holder of the drive comprises a pin which allows the contact between the two gears to be manually disengaged.

11. The bullet feeder according to claim 1, wherein the guide comprises a sensor connected to a switch for switching the drive of the rotary ring on or off.

12. The bullet feeder according to claim 1, wherein the static support comprises a stand and a central plate, wherein the central plate is detachably fixed to the stand by means of two support members, and the individual components of the bullet feeder are attached to the central plate to allow interaction between the central plate and the individual components.

* * * * *